US006072440A

United States Patent [19]

Bowman

[11] Patent Number: 6,072,440

[45] Date of Patent: Jun. 6, 2000

[54] SATELLITE RECEIVING DISH FEED HORN OR LNB COVER

[76] Inventor: Francis E. Bowman, R.R. #1 Monastery, Antigonish County, Nova Scotia, Canada, B0H 1W0

[21] Appl. No.: 09/065,434

[22] Filed: Apr. 24, 1998

[30] Foreign Application Priority Data

May 2, 1997 [CA] Canada ..... 2204295

[51] Int. Cl.[7] ..... H01Q 1/42

[52] U.S. Cl. ..... 343/872; 343/840

[58] Field of Search ..... 343/840, 872; 383/74, 75, 4; H01Q 19/12

[56] References Cited

U.S. PATENT DOCUMENTS

| | | | |
|---|---|---|---|
| 3,351,947 | 11/1967 | Hart | 343/872 |
| 3,388,401 | 6/1968 | Weir | 343/872 |
| 3,740,755 | 6/1973 | Grenzeback | 343/872 |
| 5,528,253 | 6/1996 | Franklin | 343/840 |
| 5,729,241 | 3/1998 | Ergen et al. | 343/872 |
| 5,798,735 | 8/1998 | Walton, Jr. | 343/872 |
| 5,815,125 | 9/1998 | Kelly et al. | 343/872 |

*Primary Examiner*—David H. Vu
*Assistant Examiner*—Tan Ho
*Attorney, Agent, or Firm*—Borden & Elliot

[57] ABSTRACT

A protective cover for a satellite receiving dish feed horn or LNB mounted on a support is disclosed. The cover comprises a top, sides and a back, the top and sides each having front and back edges, a forwardly and downwardly directed projection extending from the front edge of the top, and means to fasten the cover to the support or feed horn, such that the cover protects the feed horn or LNB from precipitation while not impeding signal reception.

19 Claims, 3 Drawing Sheets

FIG.1.
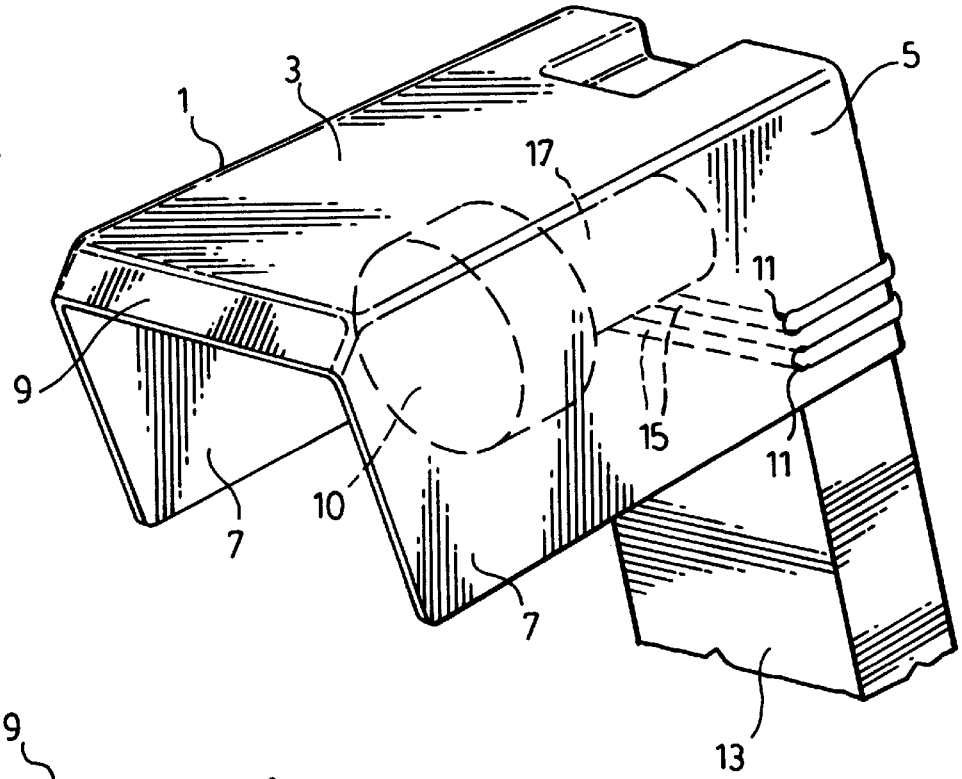
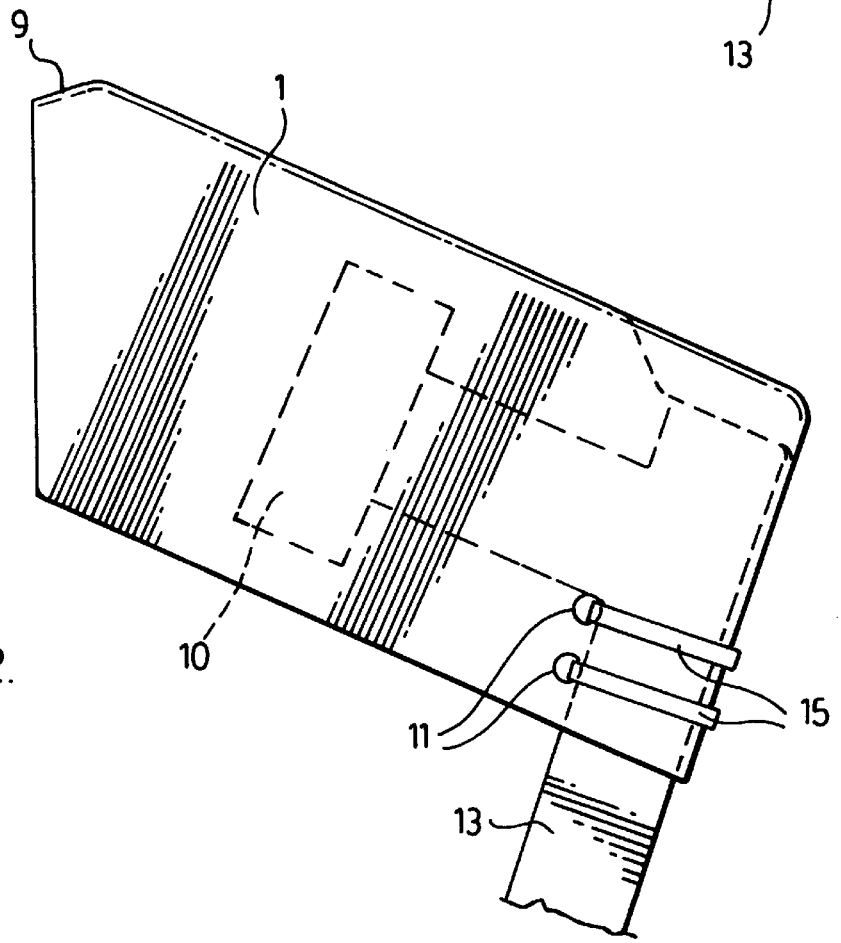
FIG.2.

SATELLITE RECEIVING DISH FEED HORN OR LNB COVER

FIELD OF THE INVENTION

Television signals may be received by the ultimate consumer by means of propagation from land-based transmitters (traditional television broadcasting), cable service (local cable providers having received the signals by ground based broadcasting or via satellite) or directly via satellite. Satellite dishes for modern digital satellite systems (DSS) are typically mounted in a fixed orientation which is only slightly above horizontal. Such dishes consist of a reflector, generally parabolic in shape, a support which typically encloses some sort of signal conductor such as coaxial cable, and the electronics of the dish which are normally enclosed within some sort of protective cover. The main electronics are located within a feed horn; in a DSS, this is often a low noise block (LNB) converter.

One of the problems with such dishes which are typically mounted in a position which exposes them to the elements, is the disruption of the signal during inclement weather. During rainy or snowy conditions, the rain or snow collecting on the LNB tends to cause the signal from the device to be interrupted. If the moisture is wiped off the LNB by the user, the signal will usually promptly return. The technique of leaving the protection of one's home to fulfil this remedial task is, however, time consuming and particularly unpleasant in rain or snow, as well as potentially physically risky if the dish is mounted on a rooftop or similar location.

Some users of such satellite dishes tie a plastic bag around the LNB to keep moisture from forming on it. Installers sometimes recommend against this step since water vapour and condensation can build up within the plastic bag and are not quickly dispersed even when rainy or snowy conditions end.

BACKGROUND OF THE INVENTION

It has been discovered that placing an appropriately constructed shield over the LNB can serve to eliminate the problem with moisture accumulation which leads to loss of signal. The shield must be constructed so as to protect the LNB from precipitation while not impeding signal reception. The same structure will work with other suitable satellite receiving dish feed horns even if they do not qualify as LNB converters.

In accordance with the invention, there is provided a protective cover for a satellite receiving dish feed horn or LNB mounted on a support, the cover comprising: a top, sides and a back; the top and sides each having front and back edges; a forwardly and downwardly directed projection extending from the front edge of the top; and means to fasten the cover to the support or feed horn; such that the cover protects the feed horn or LNB from precipitation while not impeding signal reception.

In further aspects of the invention, the cover is comprised of a lightweight, durable thermoplastic material; the cover comprises integral location means to locate the cover to the feed horn, LNB or support; the fastening means comprises openings located rearward in each side to accommodate fastening straps adapted to secure the cover to the support; the thermoplastic material is transparent; the thermoplastic material is shock-resistant; the thermoplastic material is formulated to protect the feed horn from ultraviolet radiation; the end is adapted to conform partially to the profile of the support; the fastening straps are adapted to removably secure the cover to the support; the location means comprises indentations in the back and rearward portion of the top; the projection is integral with the top and sides; insulating means are provided to minimize thermal contact between the cover and the feed horn support.

In a further aspect, the invention comprises a satellite feed horn or LNB mounted on a support, and a cover adapted to be fastened to the support or feed horn, wherein the cover is open to the air in a downwardly facing direction, and substantially open to the air in a forwardly facing direction, and is separated from the feed horn by a distance sufficient to allow air circulation between the cover and the feed horn.

In a further aspect of the invention, a method of protecting a satellite receiving dish feed horn or LNB mounted on a support comprises removably mounting a cover to the support, feed horn or LNB in spaced relation from the feed horn or LNB, wherein the cover comprises a top, sides arid a back but is substantially open to the air in the forward and downward facing directions of the feed horn or LNB.

In a further aspect, the cover is permanently fastened to the feed horn, LNB or support. Such fastening may occur during manufacture or following manufacture.

DESCRIPTION OF THE DRAWINGS

FIG. 1 is a perspective, schematic, partially cut-away view of a cover or shield installed over an LNB or feed horn and support.

FIG. 2 is a schematic, side sectional, partially cut-away view of a cover or shield instilled over an LNB or feed horn and support.

DESCRIPTION OF THE INVENTION

Figure 3:
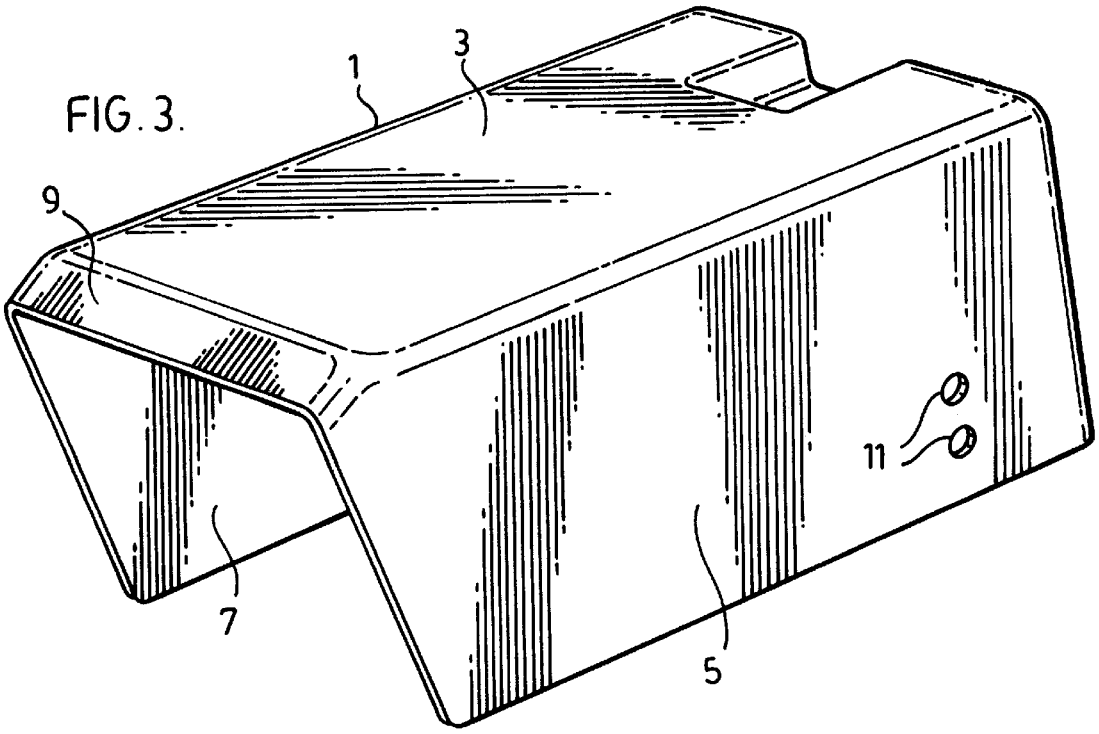
FIG. 3 is a perspective schematic view of a cover or shield.
Figure 4:
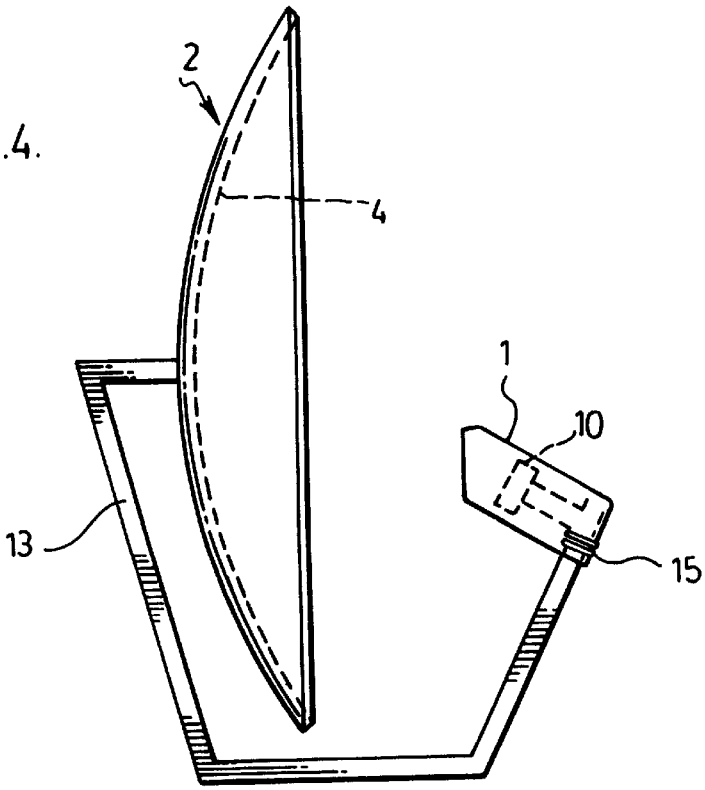
FIG. 4 is a schematic, side sectional, partially cut-away view through a satellite dish with a cover or shield installed.
Figure 5:
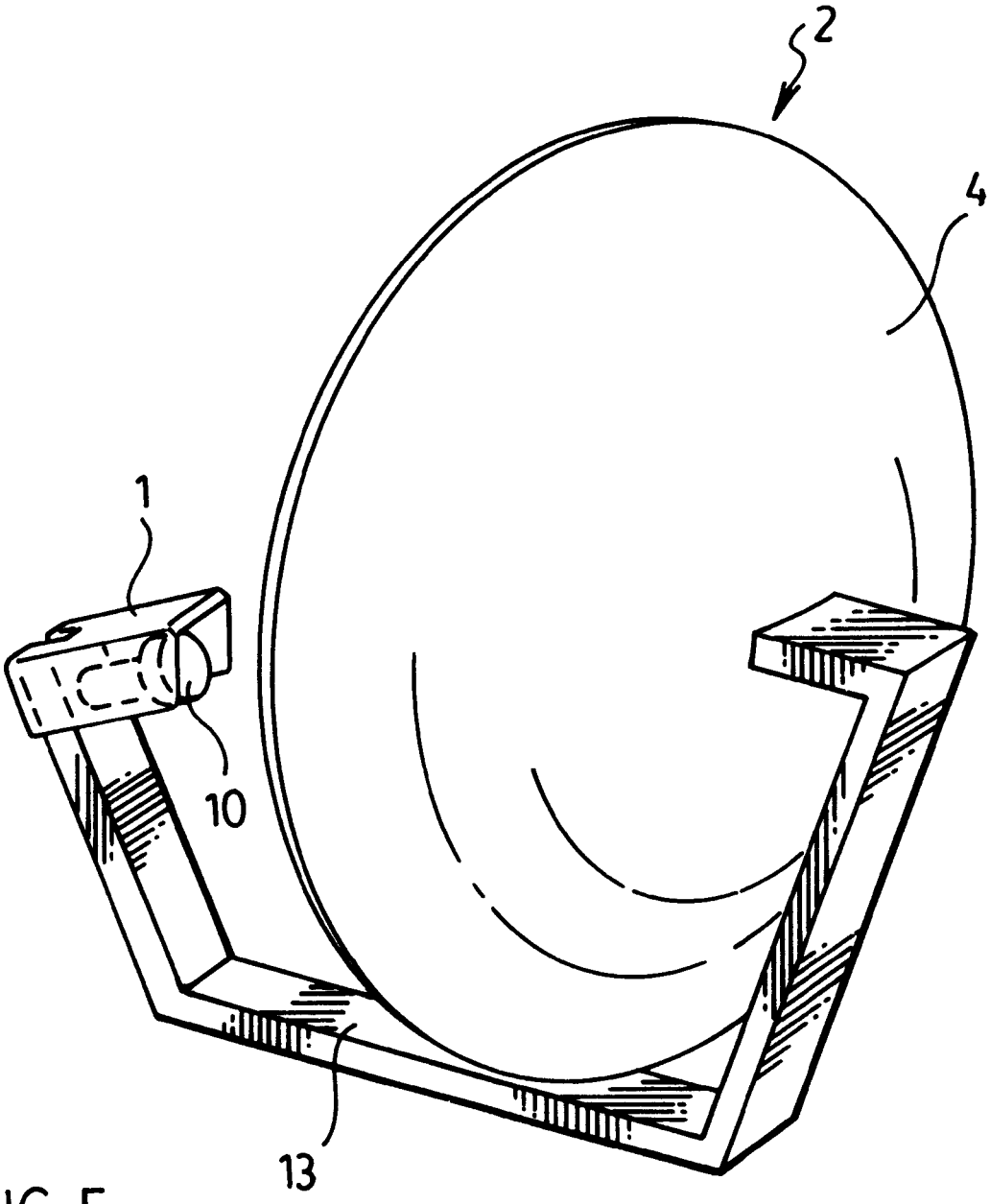
FIG. 5 is a perspective schematic, partially cut-away view of a satellite dish with a cover or shield installed.

Like parts have been given like numbers throughout the figures.

A satellite dish (2) comprises a reflector (4), support (13) and feed horn or LNB (10).

A typical cover or shield (1) is made of lightweight, durable, flexible, thermoplastic material. The material comprising the shield is preferably shock-resistant. The thermoplastic material may be clear to allow unrestricted viewing of the feed horn or LNB while the shield is installed. Additionally, the shield may be formulated to block ultraviolet radiation to slow degradation of the feed horn or LNB by sunlight. Alternatively, the shield may be coloured or opaque. It has a top (3), a back (5), and sides (7), but no front or bottom. A flap (9) extending from the top a short distance serves to direct falling precipitation away from the feed horn or LNB (10) rather than allowing it to roll or collect inside the shield. Accordingly, the shield is open to the air in a downwardly facing direction, and substantially open to the air in a forwardly facing direction. The shield has openings (11) at the sides and back, or either of them, to allow it to be tied to the support (13) which leads up to the feed horn or LNB, or to the feedhorn or LNB (10) itself. The back and the top, or either of them, may comprise integral location means (17) to locate the cover to the feed horn, LNB or support. The location means in FIG. 1 comprises an indentation in the back and rearward portion of the top which conforms to the shape of a portion of the support. The back is adapted to conform partially to the profile of the support.

The shield itself typically does not directly touch the feed horn or LNB so that there is room for ar circulation around the LNB or feed horn and minimal mechanical transmission of heat or cold from the shield to the LNB occurs. Alternatively, or in addition, insulating material (not shown) can be placed between the feed horn or LNB and the shield to isolate these elements thermally.

If the front flap extends too far (assuming the material is thick enough), the signal from the LNB or feed horn may also be interrupted. Accordingly, it is important to have a front flap which is sufficiently extended to direct water away from the interior of the shield without obstructing the signal from the reflector to the LNB.

The shield also protests the LAB from relatively small flying objects such as stones and other debris. In the normal configuration in which the shield is removably attached, it is easily removed for cleaning if this should become necessary. Fastening straps or ties (15) of any suitable form, which pass through the openings (11) and around the support (13) or the feed horn or LNB may be employed.

Alternatively, the shield can be moulded as part of the dish, particularly the LNB or feed horn, or the support, during manufacture or permanently affixed to the dish as an added option following construction or installation of the dish.

Although a preferred embodiment of the invention has been described, modifications of the device will be apparent to those skilled in the art without departing from the substance of the invention.

I claim:

1. A protective cover for a satellite receiving dish feed horn or LNB mounted on a support, the cover comprising:

1) a top, sides and a back;

2) the top and sides each having front and back edges;

3) a forwardly and downwardly directed projection extending from the front edge of the top;

4) means to fasten the cover to the support or feed horn; such that the cover is open to the air in a downwardly facing direction, and substantially open to the air in a forwardly facing direction, and protects the feed horn or LNB from precipitation while not impeding signal reception.

2. A protective cover as in claim 1, wherein the cover is permanently fastened to the support.

3. A protective cover as in claim 1, wherein the cover is comprised of a lightweight, durable, thermoplastic material.

4. A protective cover as in claim 3, wherein the thermoplastic material is transparent.

5. A protective cover as in claim 3, wherein the thermoplastic material is shock-resistant.

6. A protective cover as in claim 3, wherein the thermoplastic material is formulated to protect the feed horn or LNB from ultra-violet radiation.

7. A protective cover as in claim 3, wherein the back is adapted to flex to conform partially to the profile of the support.

8. A protective cover as in claim 1, wherein the cover comprises integral location means to locate the cover to the feed horn or support.

9. A protective cover as in claim 8, wherein the location means comprises indentations in the back and rearward portion of the top.

10. A protective cover as in claim 1, wherein the fastening means comprises openings located rearward in each side to accommodate fastening straps adapted to secure the cover to the support.

11. A protective cover as in claim 10, wherein the fastening straps are adapted to removably secure the cover to the support or feed horn.

12. A protective cover as in claim 1, wherein the projection is integral with the top and sides.

13. A protective cover as in claim 1, further comprising insulating means to minimize thermal contact between the cover and the feed horn support.

14. A protective cover as in claim 13, where the insulating means comprises air.

15. A satellite receiving dish feed horn protection system comprising a satellite feed horn or LNB mounted on a support, and a cover adapted to be fastened to the support or feed horn or LNB, wherein the cover is open to the air in a downwardly facing direction, and substantially open to the air in a forwardly facing direction, and is separated from the feed horn or LNB by a distance sufficient to allow air circulation between the cover and the feed horn.

16. A method of protecting a satellite receiving dish feed horn or LNB mounted on a support, comprising removably mounting a cover to the support in spaced relation from the feed horn or LNB, wherein the cover comprises a top, sides and a back but is substantially open to the air in the forwardly and downwardly facing directions of the feed horn or LNB.

17. The method of claim 16, wherein the cover is installed during manufacture.

18. The method of claim 16, wherein the cover is molded as part of the satellite dish during manufacture.

19. The method of claim 16 wherein the cover is molded as part of the LNB or feed horn during manufacture.

* * * * *